US005463451A

United States Patent [19]

Acquaviva et al.

[11] Patent Number: 5,463,451

[45] Date of Patent: Oct. 31, 1995

[54] DOCUMENT REPRODUCTION SYSTEM INCLUDING A DUPLEX DOCUMENT HANDLER WITH NATURAL INVERSION

[75] Inventors: Thomas Acquaviva, Penfield; James D. Rees, Pittsford; Paul F. Morgan, Rochester; Joseph J. Ferrara, Webster, all of N.Y.

[73] Assignee: Xerox Corporation, Stamford, Conn.

[21] Appl. No.: 340,002

[22] Filed: Nov. 15, 1994

[51] Int. Cl.[6] ..... G03G 15/04; G03G 15/23

[52] U.S. Cl. ..... 355/233; 355/320; 355/23; 355/24; 358/486; 358/496; 358/498

[58] Field of Search ..... 358/498, 496, 358/494, 486, 474; 355/228, 232, 233, 24, 319, 320, 23

[56] References Cited

U.S. PATENT DOCUMENTS

| | | | |
|---|---|---|---|
| 3,833,296 | 9/1974 | Vola et al. | 355/51 |
| 3,884,653 | 10/1974 | Kelly | 355/233 |
| 3,936,171 | 2/1976 | Brooke | 355/23 X |
| 3,980,406 | 9/1976 | Lang | 355/24 |
| 3,998,543 | 12/1976 | Wick et al. | 355/24 |
| 4,035,073 | 7/1977 | Del Vecchio | 355/24 |
| 4,248,528 | 2/1981 | Sahay | 355/320 X |
| 4,419,007 | 12/1983 | Kingsley | 355/233 X |
| 4,429,333 | 1/1984 | Davis et al. | 358/293 |
| 4,475,128 | 10/1984 | Koumura | 358/296 |
| 4,475,156 | 10/1984 | Federico et al. | 364/300 |
| 4,536,077 | 8/1985 | Stoffel | 355/24 X |
| 4,571,636 | 2/1986 | Itoh | 355/23 X |
| 4,673,285 | 6/1987 | Shogren | 355/23 |
| 4,734,742 | 3/1988 | Klumpp et al. | 355/23 |
| 4,743,974 | 5/1988 | Lockwood | 355/23 X |
| 4,908,719 | 3/1990 | Nonoyama | 358/494 |
| 5,136,665 | 8/1992 | Inoue | 358/496 X |
| 5,280,368 | 1/1994 | Fullerton | 358/474 |
| 5,298,937 | 3/1994 | Telle | 355/23 |
| 5,339,139 | 8/1994 | Fullerton et al. | 355/215 |
| 5,339,175 | 8/1994 | Omata et al. | 358/498 |
| 5,392,135 | 2/1995 | Amemiya | 358/486 X |

OTHER PUBLICATIONS

Richard E. Smith, "Automatic Duplex Document Electronic Scanning," *Xerox Disclosure Journal,* vol. 8, No. 3, May/Jun. 1983, p. 263.

James D. Rees and William Lama, "Some Radiometric Properties of Gradient–Index Fiber Lenses," (Applied Optics, vol. 19, No. 7, Apr. 1, 1980, pp. 1065–1069.

*Primary Examiner*—Matthew S. Smith

[57] ABSTRACT

The invention is directed to a document reproduction system which includes an improved apparatus for imaging both sides of a duplex document while also providing for simplex side only imaging. A document feeder, operating in a constant velocity transport mode, moves a document to be copied along a continuous path from a feed tray to a deposit tray. Two illumination and scanning stations are positioned adjacent two locations of the path of the document travel, each scanning station adapted to scan one side of the document, either simplex or duplex. The scanning station associated with scanning the simplex side of the document projects line images of the scanned document along an optical path onto a light sensitive image medium. In a first embodiment, the projection device is a linear gradient index lens array and the light sensitive member is a linear sensor array. The scanning station associated with scanning the second, duplex, side of the document projects the duplex side line images, via a second gradient index lens array, along an optical path which is generally optically aligned with, and includes, the first optical path. Thus, the duplex line images are projected through a first gradient index lens array whose output is optically coupled into and projected by the lens array associated with the simplex scanning. Control devices are provided to enable a simplex or duplex mode of operation. Several embodiments of the invention are provided to demonstrate feasibility with document feeder inputs at different locations.

19 Claims, 4 Drawing Sheets

DOCUMENT REPRODUCTION SYSTEM INCLUDING A DUPLEX DOCUMENT HANDLER WITH NATURAL INVERSION

BACKGROUND AND DISCLOSURE STATEMENT

Cross-reference and incorporation by reference is made to commonly assigned co-pending application 08/134,775 and U.S. Pat. No. 5,339,139, both disclosing simplex and duplex document handlers.

The present invention relates to a document reproduction system which includes an improved document scanning system for automatically transporting documents to a document platen and for scanning the document to form line images at an image plane. More particularly, the invention relates to a scanning system capable of imaging documents in either a simplex or duplex mode of operation using sequentially enabled exposure stations.

There is extensive art on simplex or duplex document feeders used in light lens copiers and/or electronic (digital) printers which use a raster input scanner (RIS). This prior art is summarized in U.S. Pat. No. 5,339,139, referenced supra.

In the referenced prior art, a commonly used method of enabling a duplex document handling mode is to image a first (simplex) side at an exposure station and then to use an inverted mechanism to reverse the path of the document and bring the second (duplex) side into the same exposure station. See for example, U.S. Pat. No. 4,419,007. Inversion requires sheet movement changes and additional mechanisms to start and stop the inverted mechanism creating losses in productivity and also resulting in frequent document jams. Duplex scan systems are also known which expose both sides of a document while the document is moved along a continuous, non-inversion path. U.S. Pat. Nos. 4,571,636 (Itoh), 4,673,285 (Shogren) and 4,536,077 (Stoffel) all disclose use of two scan illumination stations, one for each side of the document, with the simplex and duplex scanned images following two optical paths but imaged onto the same image line. These references require a moving mirror (Stoffel or Itoh) or a moving lens (Shogen) to bring projected images onto a common imaging plane. U.S. Pat. No. 4,429,333 discloses a single exposure station, but it must move from a simplex side exposure station to a duplex exposure location. See also, *Xerox Disclosure Journal* Volume 8, Number 3, May/June 1983, page 263 which discloses use of two RIS stations to image both sides of the document. Moving optical components is undesirable because it can create optical misalignments and/or vibrations, is time consuming and requires precision mechanisms.

It is a feature of the disclosed embodiments to provide a duplex document imaging system which houses the document feeding and imaging components within a compact space. It is a still further feature to project simplex and duplex images at an image plane with a fixed optical system not requiring any movable components. It is a further operational feature to identify whether a simplex or duplex mode of operation is enabled and to provide an optimum feed path for either mode.

The disclosed embodiments include a scanning system with simplex and duplex modes of operation wherein two exposure stations are provided, one for each mode. Each exposure station projects line images along a optical path which includes one or two gradient index lens arrays for simplex or duplex operation, respectively. These lens arrays are characterized by having a short focal length and can be used in an optical system having a relatively short total conjugate thus enabling a compact optical unit. The lens array forms a focused, erect 1X image of a scanned document at an imaging plane. The gradient index lens arrays comprise a plurality of light conducting fibers made of glass or synthetic resin which has a refractive index distribution in a cross section thereof that varies parabolically outward from a center portion thereof. Each fiber acts as a focusing lens to transmit part of an image of an object placed near one end, e.g., each side of a document. An assembly of fibers, typically in a two row linear array, transmit and focus an image of the object. These fiber lenses may be those produced under the trade name "SELFOC", a mark registered in Japan and owned by the Nippon Sheet Glass Co., Ltd.

The embodiments are disclosed in a digital imaging system embodiment wherein simplex and duplex document sheets are circulated through an exposure zone by a CVT (constant velocity transport) document handling system and one or both sides are selectively and sequentially imaged onto a common linear sensor array. The document sheets may be controlled in (1 to N) serial order along a very short path in a continuous direction without the need for inversion of the sheet for duplex imaging.

Several embodiments are disclosed below which illustrate the application of the invention to accommodate various locations of a document feed tray appropriate for different overall machine designs.

More particularly, one feature relates to a document reproduction system for imaging both sides of duplex documents and for additionally imaging simplex documents, said document reproduction system including an automatic document feeding and imaging system for scanning both sides of document sheets and for projecting line images of the scanned document sides onto a light sensitive imaging member, said document feeding and imaging system comprising, in combination, a first object plane, a first scanning station positioned beneath said first object plane, for scanning the first side of the document, said first scanning station including a first illumination system to illuminate a first exposure zone in said first object plane and further including a first lens system for projecting light reflected from said documents moving through said exposure zone as focused line images along a first optical path onto said light sensitive image member, a second object plane, a second scanning station positioned beneath said second object plane for scanning a second side of the document, said second scanning station including a second illumination system to illuminate a second exposure zone in said second object plane and further including a second lens system for projecting light reflected from documents moving through said second exposure zone along a second optical path superimposed with said first optical path onto said light sensitive member, a document feeding and control system for selectively feeding documents to be imaged at one of said first and second scanning stations in a simplex document mode of operation and through both said first and second scanning stations in a duplex document mode of operation, said control system selectively actuating said first and second illumination systems in response to said selected mode of operation.

Further disclosed features, individually or in combination, include, in the document reproduction system described above, the use of linear gradient index lens arrays as the first and second lens systems and a linear light sensor array as the light sensitive member. A further feature is that the first gradient index lens array has a field capability in the cross array direction as large or larger than the second gradient index lens array. As a still further feature, the first and second illumination systems described above are incrementally illuminated by said control system for scanning a document, moving through said first and second exposure zones and wherein the illumination level of the second illumination system associated with the second scanning station is the same or higher than the first illumination system. There is also disclosed a document feeding and imaging apparatus for sequentially scanning both sides of sequentially fed duplex documents and for projecting line images thereof along an optical path onto a light sensitive imaging member comprising, in combination, a first document scanning station for scanning a first side of the duplex documents, a first optical path for projecting line images of the first document side by a first projection lens onto said light sensitive imaging member, a second document scanning station for scanning a second side of the duplex documents, and a second optical path for projecting line images thereof by a second projection lens.

Further disclosed features, individually or in combination, include, in the document feeding and imaging apparatus described above, control of said first and second document scanning stations to alternatively provide linear feeding therethrough and imaging of simplex documents. A further feature is that the first document scanning station is a minor portion of the upper surface of a conventional fixed glass platen of a document reproduction apparatus. A still further feature is that said first and second document scanning stations are vertically superposed. A still further feature is that a single inversion loop document feeding path interconnects said first and second document scanning stations. Another feature is that the document line images from one said scanning station pass through the other said scanning station by optical alignment of said first and second projection lenses. An additional feature is the inclusion of a document feeding path wherein both simplex and duplex documents are moved therethrough without stopping. A still further feature is a document input feeder feeding directly into one of said first and second document scanning stations without inversion from a closely adjacent stack thereof in forward serial order. Another feature is that all optical imaging elements thereof are fixed in position for imaging of both simplex and duplex documents. A further feature is a field lens positioned in a minor portion in a field of said second gradient index lens array.

DESCRIPTION OF THE EMBODIMENTS

In the following description, the term "document" is the sheet (original or previous copy) being imaged. A "simplex" document (or copy sheet) is one having its image and page number on only one side or face of the sheet, whereas a "duplex" document (or copy sheet) has "pages", and normally images, on both sides, i.e., each duplex document is considered to have two opposing sides, faces, or "pages" even though no physical page numbers may be present.

Figure 1:
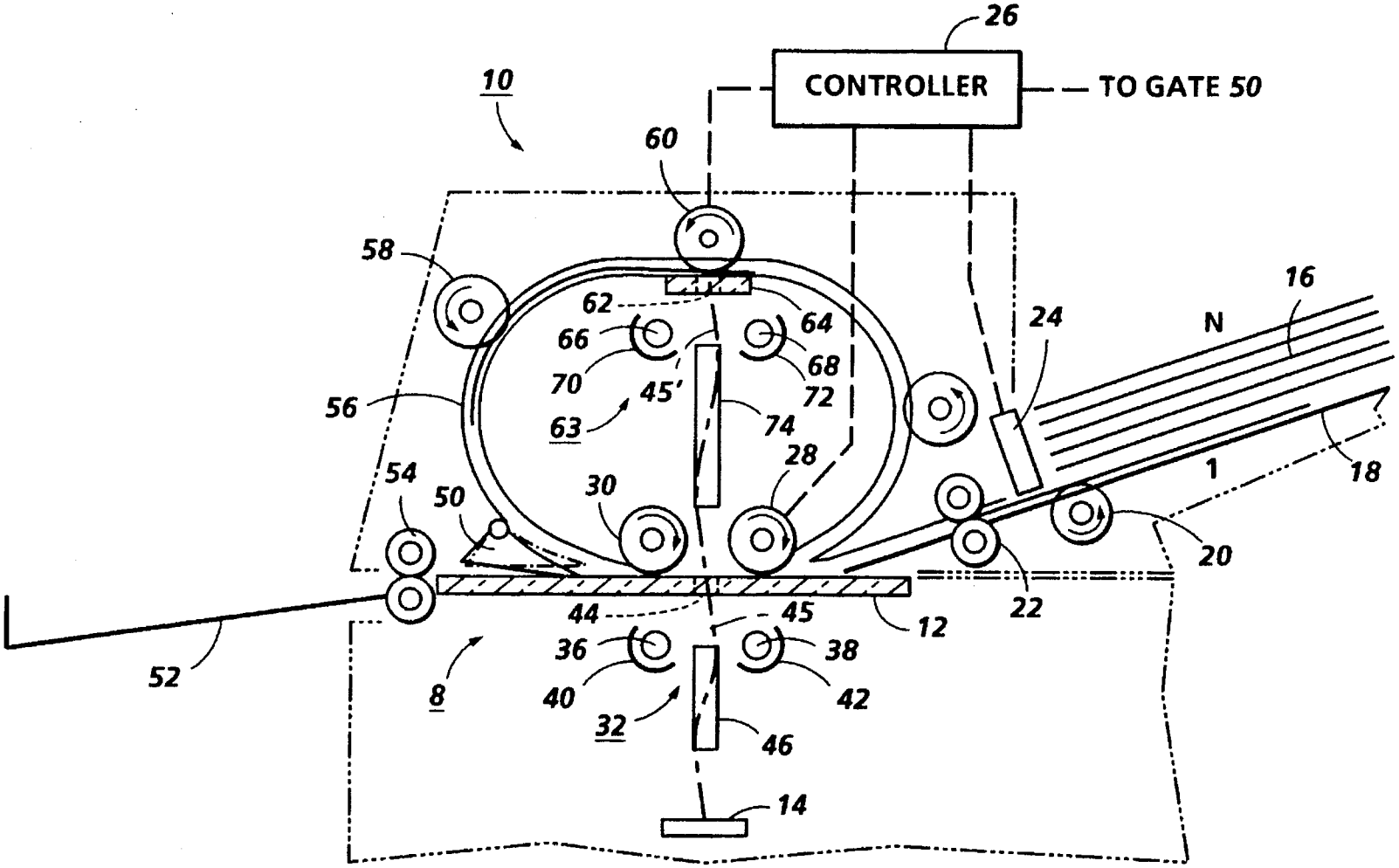
FIG. 1 is a partially schematic front view of a first embodiment of the invention for electronic scanning of duplex and simplex documents fed from a bottom feed 1 to N face down document stack input tray.

Referring first to FIG. 1, there is shown a partially schematic front view of a portion of a document reproduction system which includes a RIS imaging system 8, a document handler 10 overlying a platen 12 and feeding duplex documents in 1 to N order along a continuous feed path with both sides of the document being sequentially scanned and imaged onto sensor array 14. Simplex documents are fed substantially linearly through only the lower part of the path. The documents 16 are placed face down in input tray 18 with the bottom document fed therefrom by a bottom friction, or other known feeder 20 in combination with a feed roll pair 22. A sensor 24 may be desirably provided to scan the back (duplex) side of document 16 to determine if it is duplex; i.e., if information exists thereon. The sensor output is sent to controller 26 to enable a simplex or duplex mode of operation as will be seen. Alternately, an operator switch can be enabled for duplex input. Controller 26 preferably and conventionally comprises a known type of programmable microprocessor system, as exemplified by extensive prior art, e.g. U.S. Pat. No. 4,475,156. The particular desired functions and timings thereof may be provided by conventional software programming of the controller 26 in nonvolatile memory. The controller 26 controls all of the steps and functions described herein.

Continuing with a description of the FIG. 1 embodiment, and assuming that a simplex document is being copied (no information being detected by sensor 24), the document 16 is advanced onto and across platen 12 by CVT feeder roller pairs 28, 30. Situated beneath platen 12 is a first scanning station 32. Station 32 comprises a pair of elongated fluorescent document illumination lamps 36, 38 with associated reflectors 40, 42, respectively. A band of illumination is directed towards and through platen 12 to form a first narrow exposure zone 44 of uniform illumination extending across the width of the platen (into the page). As document 16 is moved past the exposure zone 44, a narrow band of light is reflected downward from the document along a first optical path 45, by a linear gradient index lens array 46 and as a line on the surface of a linear full width sensor array 14. It is understood that zone 44, lens array 46 and sensor array 48 all have a width into the page sufficient to image light reflected from the width of the document passing through exposure zone 44. The simplex document 16 is moved beneath a raised gate 50, fed by feed roll pair 54 and conveyed face down to catch tray 52.

For operation in the duplex mode, sensor 24 senses information on the duplex side of the sheet and sends a signal to controller 26 which generates an output signal pivoting gate 50 clockwise lowering the gate into the document path. The simplex side of document 16 is imaged as described above; however, gate 50 now diverts the sheet upwards and along a half-loop inverting path configuration defined by arcuate baffle member 56. CVT roll pairs 58, 60 move the document into a second exposure zone 62 formed at the interface of CVT roll 60 and a separate small platen 64. The exposure zone 62, superimposed above zone 44, is scan-illuminated by a second scanning station 63 comprising fluorescent lamps 66, 68 with associated reflectors 70, 72, respectively. These lamps 66, 68 are only energized by controller 26 following receipt of the "duplex" signal from sensor 24. The lamps 36, 38 are first turned off. The sequential operation of the two illumination lamps ensures that, for simplex operation, lamps 66, 68 are not turned on thereby avoiding any possible "bleed through" of information from the back (duplex) side of the document and for duplex operation, lamps 36, 38 are turned off to avoid light scattering which might reduce image contrast. The back side of duplex document 16 is imaged line by line with line images reflected from zone 62 along an optical path 45' which is generally optically aligned with, and constitutes an extension of, optical path 45. The reflected duplex line images are projected by a second gradient index lens array 74 through platen 12 (which is in the image plane of lens array 74) and thence along optical path 45 to be projected as duplex line images by lens array 46 onto sensor array 14. Lens arrays 74 and 46, operating as relay lenses, maintain a single, focused line of exposure at sensor array 14. This ability to form a single line exposure of large documents with two lens arrays with short total conjugates is due to the characteristics of the SELFOC lens. A general description of the operation of a SELFOC lens is disclosed in an article by James D. Rees and William Lama entitled, Some Radiometric Properties of Gradient-Index Fiber Lenses, (Applied Optics, Volume 19, No. 7, Apr. 1, 1980, pages 1065–1069) whose contents are hereby incorporated by reference. From any exposure point on the array 14, illumination is being received from a group of fibers from lens array 46 (simplex mode). For the duplex mode, each portion of the focused line images at platen 12 is also being illuminated by groups of fibers from lens array 74 and relayed by lens array 46 to sensor 14.

In the FIG. 1 embodiment, sensor 24 is a low-cost, low-resolution sensor which detects the presence or absence of information on the duplex side of the document. The sensor detects light reflected from the surface by a light source. The sensor arrangement disclosed for this same purpose in U.S. Pat. No. 4,248,528, column 10, lines 17–40 could be used to perform this function, for example. The contents of this patent are incorporated by reference.

Still referring to FIG. 1, it is preferable that lens array 46 has a field capability in the cross array (image line width) direction as large or larger than that of lens array 74. This field relationship between the two lens arrays can be achieved by using a commonly available SELFOC SLA6 for lens array 74 and a SELFOC SLA9 for array 46. For this configuration, the illumination intensity of lamps 66, 68 is increased, compared to the intensity of lamps 36, 38, by signals from controller 26 to a lamp power supply (not shown). Other mechanisms could be used to increase illumination at exposure zone 62 such as cycling in a lamp/reflector pair of greater output. If lens arrays of equal fields are used, a field lens at the image platen (platen 12) of lens 74 may be required.

As a further observation, to ensure that the circulating document is not blocking the duplex image path, the system must be designed to ensure that, for the longest document to be copied, the trail edge must clear the exposure zone 44 before the lead edge reaches exposure zone 62.

The advantages of the disclosed imaging systems are readily apparent. Productivity is 100 percent for the simplex mode and only one skipped pitch for the duplex mode of operation. Documents can be fed to either scanning station. Documents move continuously and do not change direction. There are no moving optical components required along the entire optical path. Simplex and duplex documents may be restacked face down in the same output tray 52.

Figure 2:
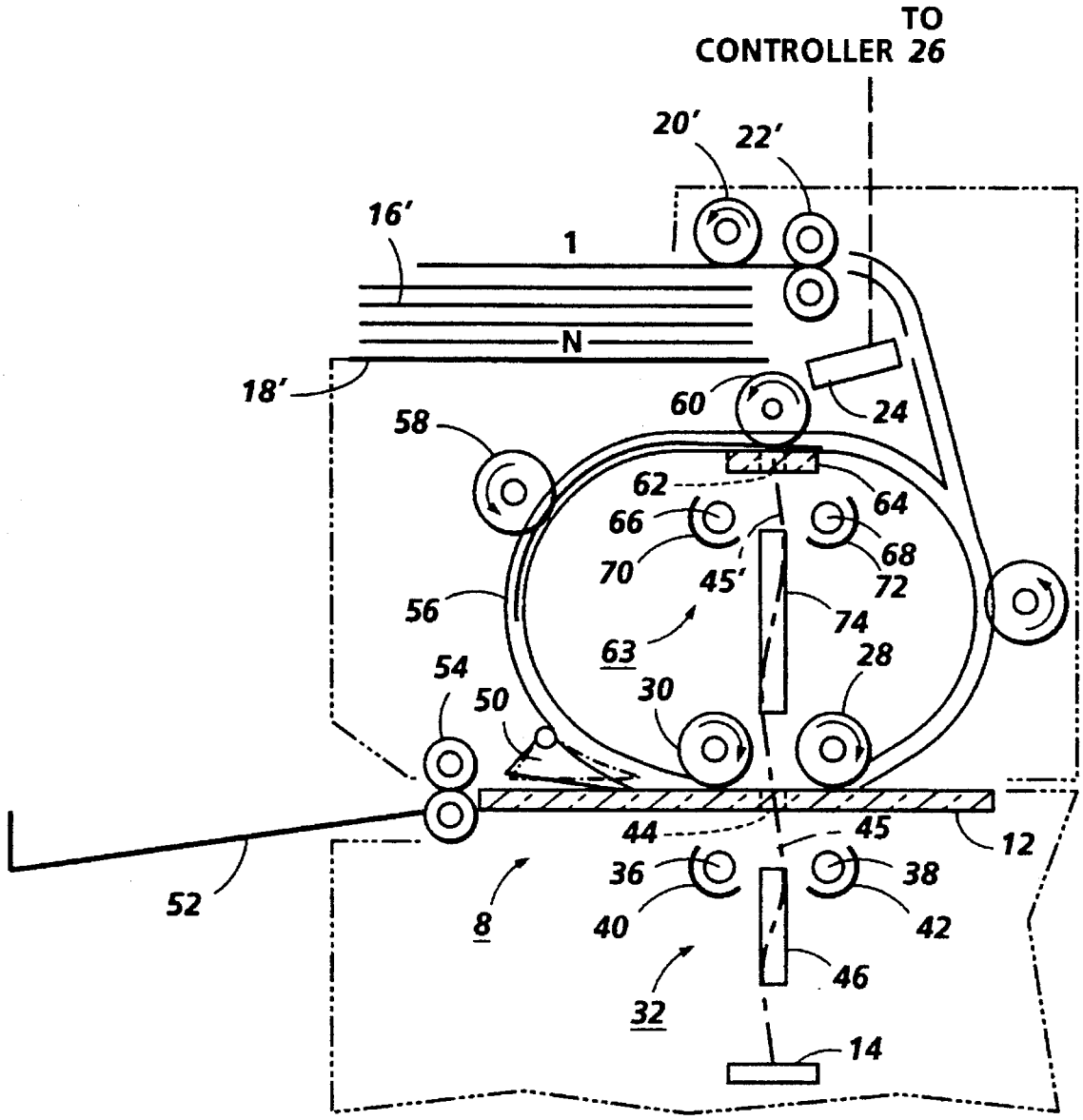
FIG. 2 is a partial schematic front view of a second embodiment of the invention showing a top feed 1 to N document input from an overlying input tray.

FIG. 2 shows a second embodiment with identical scanning stations as in the FIG. 1 embodiment, but with a 1–N top feeder and with the documents loaded face up. For this embodiment, documents 16 are placed face up in the input tray 18' with the top document fed therefrom by top friction feeder 20' in combination with feed roll pair 22'. Sensor 24 again senses the duplex side to determine which mode of operation will be enabled. The simplex or duplex scanning operations are the same as described for the FIG. 1 embodiment.

Figure 3:
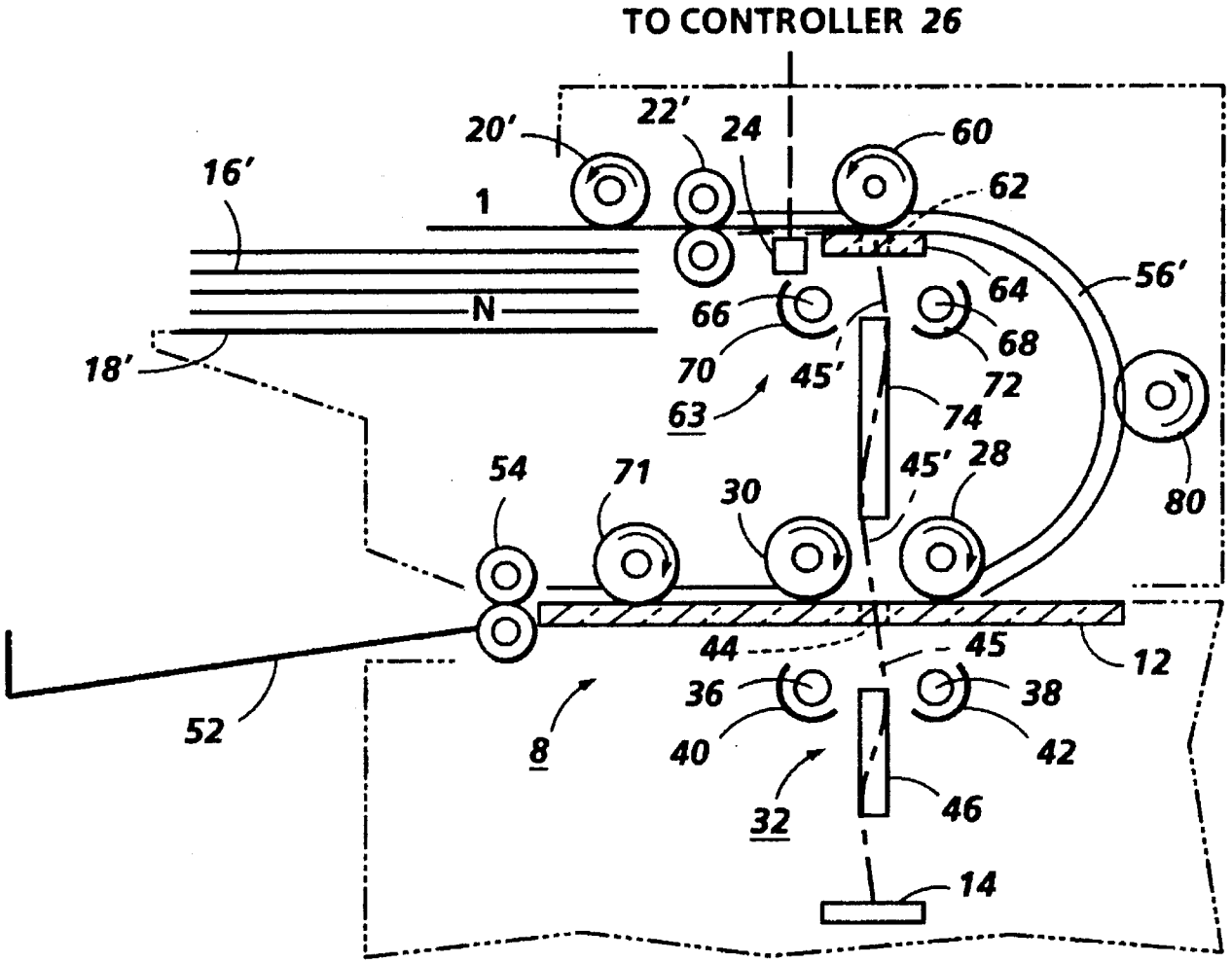
FIG. 3 is a modification of the FIG. 2 embodiment incorporating a significantly shorter feed path and a single document inversion.

FIG. 3 shows a third embodiment, similar to the FIG. 2 embodiment, but with the input tray 18' aligned horizontally with a feed path directly and linearly into the second exposure zone. Since this configuration has a single, half-loop inversion path, it provides a shorter path which can be more productive. In the simplex mode of operation, the documents are fed from input tray 18' by top friction feeder 20' in combination with feed roll pair 22'. Sensor 24 scans the bottom or duplex side of document 16 to detect information thereon. If the document is simplex, output signals are generated to energize the first (simplex) illumination system only (lamps 36,38) while the second (duplex) illumination system (lamps 66,68) remain de-energized. The document is conveyed through baffle 56' by roller 80 and CVT rolls 28, 30 and is scanned only at station 32. The imaged document is conveyed face down to catch tray 52 by feed roller pair 54 and roller 71.

For duplex operation of the FIG. 3 embodiment, information on the bottom (duplex) side of the document is detected by sensor 24 as the sheets are fed from tray 18'. Signals from controller 26 first energize lamps 66, 68. These lamps are de-energized when the trailing edge of the sheet passes zone 62, and then illumination lamps 36, 38 are energized. Thus, first the duplex side of the image is scanned followed by the scanning of the simplex side through lens array 46. For this embodiment productivity is 100 percent in either simplex or duplex modes of operation. i.e., there are no skipped pitches.

Figure 4:
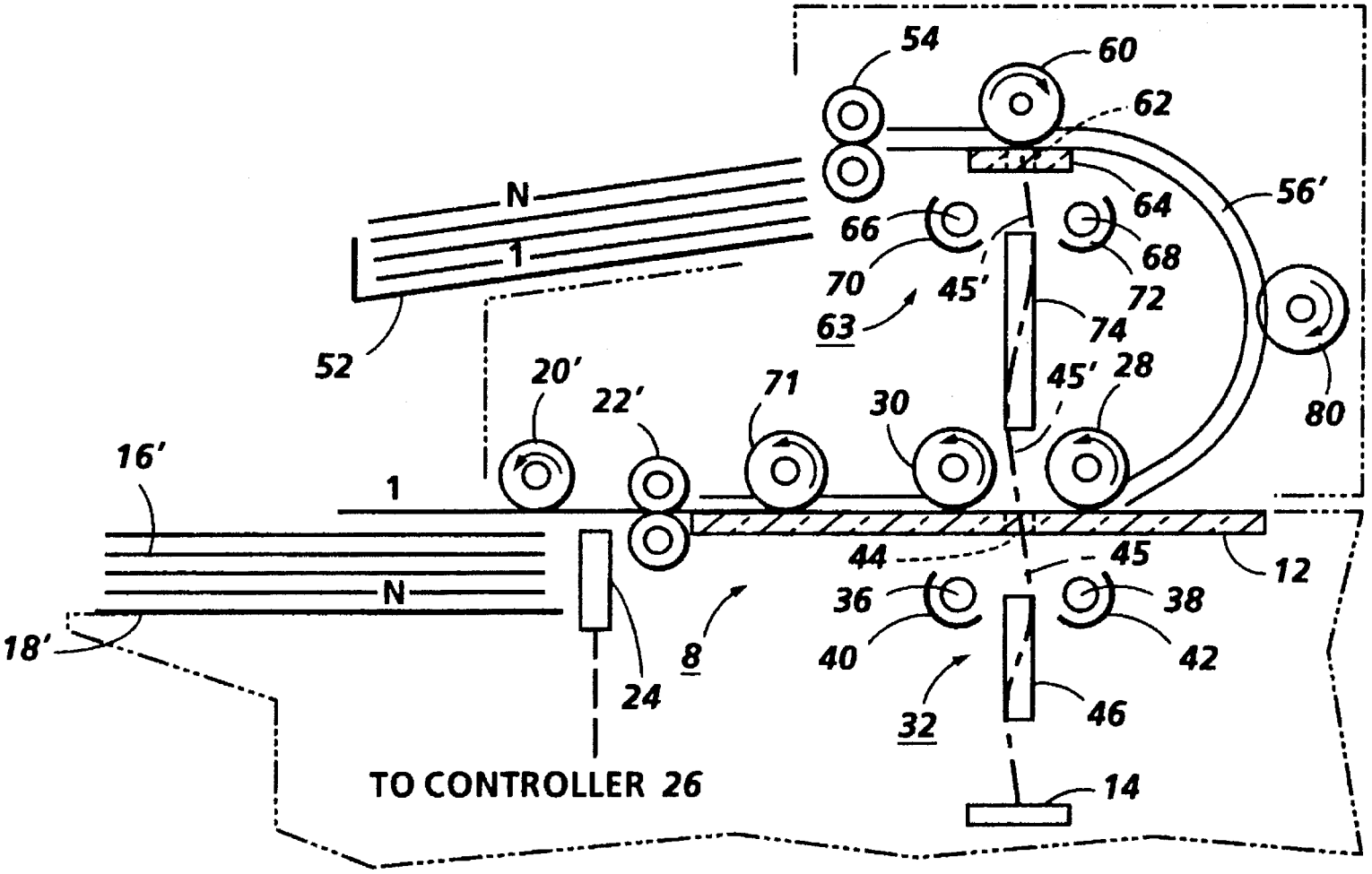
FIG. 4 is a partial schematic front view of another embodiment of the invention showing a top feed 1 to N face up feed with the input tray beneath the output tray.

FIG. 4 shows a fourth embodiment of the invention with the input tray 18' below the output catch tray 52. This embodiment, like that of the FIG. 3 embodiment, eliminates a portion of the path and provides a shorter path. The documents 16' are loaded face up and fed from tray 18' in 1–N sequence by feeder 20'. All feed rollers, for this embodiment, are rotated in a direction opposite the other embodiments to move the documents in a generally CCW direction. Sensor 24 scans the bottom, or duplex, side of document 16'. If the document is simplex, the first scanning station 32 is not activated. The document is moved into scanning station 63 which is activated, imaging the top (simplex) side of the document. The document is stacked face down in 1–N order in tray 52. If the document is duplex scanning station 32 is energized to scan the duplex side while the station 63 remains de-energized. As the document is moved to exposure zone 62, station 32 is de-energized and station 63 energized. This embodiment is more productive in the duplex mode since there are no skipped pitches. In the simplex mode, the first side of the document must clear imaging station 63 before feeding the next document.

It is understood that the previous embodiments may be configured in a light lens copier incorporating a conventional photoconductor drum or belt moving through the image plane; e.g., the plane in which sensor array 14 is shown positioned in FIGS. 1 through 4. For this light lens embodiment, a field lens may be needed at the exposure zone 44 to provide sufficient illumination to the conventional slit aperture associated with the belt or drum imaging. A preferred embodiment is a Fresnel lens or a binary diffraction optic lens, both having a flat upper surface, which may be incorporated into the platen at exposure area 44.

While the embodiment disclosed herein is preferred, it will be appreciated from this teaching that various alternative, modifications, variations or improvements therein may be made by those skilled in the art, which are intended to be encompassed by the following claims:

We claim:

1. In a document reproduction system for imaging both sides of duplex documents and for additionally imaging simplex documents, said document reproduction system including an automatic document feeding and imaging system for scanning both sides of document sheets and for projecting line images of the scanned document sides onto a light sensitive imaging member, said document feeding and imaging system comprising, in combination, a first object plane, a first scanning station positioned beneath said first object plane for scanning a first side of the document, said first scanning station including a first illumination system to illuminate a first exposure zone in said first object plane and further including a first lens system for projecting light reflected from said documents moving through said exposure zone as focused line images along a first optical path onto said light sensitive image member, a second object plane, a second scanning station positioned beneath said second object plane for scanning a second side of the document, said second scanning station including a second illumination system to illuminate a second exposure zone in said second object plane and further including a second lens system for projecting light reflected from documents moving through said second exposure zone along a second optical path superimposed with said first optical path onto said light sensitive member, a document feeding and control system for selectively feeding documents to be imaged at one of said first and second scanning stations in a simplex document mode of operation and through both said first and second scanning stations in a duplex document mode of operation, said control system selectively actuating said first and second illumination systems in response to said selected mode of operation.

2. The document reproduction system of claim 1 wherein said first and second lens systems are linear gradient index lens arrays and said first gradient index lens array has a field capability in the cross array direction as large or larger than the second gradient lens array.

3. The document reproduction system of claim 1 wherein said first and second object planes are defined by first and second transparent platens and said documents are conveyed across the surface of said platens.

4. The document reproduction system of claim 3 wherein said first and second illumination systems are incrementally illuminated by said control system for scanning a document moving through said first and second exposure zones and wherein the illumination level of said second illumination system associated with said second scanning station is higher than said first illumination system.

5. The document reproduction system of claim 1 wherein said light sensitive member is a linear light sensor array.

6. A document feeding and imaging apparatus for sequentially scanning both sides of sequentially fed duplex documents and for projecting line images thereof along an optical path onto a light sensitive imaging member comprising, in combination, a first document scanning station for scanning a first side of the duplex documents, a first optical path for projecting line images of the document side by a first projection lens onto said light sensitive imaging member, a second document scanning station for scanning a second side of the duplex documents, a second optical path for projecting line images thereof by a second projection lens and wherein said second optical path is optically coupled to, and includes, said first optical path.

7. The apparatus of claim 6 further including control means for sequentially enabling said first and second scanning stations.

8. The apparatus of claim 7 wherein said light sensitive imaging member is a linear light sensor array.

9. The apparatus of claim 7 wherein said light sensitive imaging member is a photosensitive member.

10. The apparatus of claim 6 wherein said first projection lens is a first linear gradient index lens array and wherein said second projection lens is a second linear gradient index lens array superimposed with said first gradient index lens array.

11. The apparatus of claim 10 wherein said first gradient index lens array has a field as large or larger than said second field lens array.

12. The apparatus of claim 6 wherein one of said first and second document scanning stations alternatively provides linear feeding therethrough and imaging of simplex documents.

13. The apparatus of claim 6 wherein said first document scanning station is a minor portion of the upper surface of a conventional fixed glass platen of a document reproduction apparatus.

14. The apparatus of claim 6 wherein said first and second document scanning stations are vertically superposed.

15. The apparatus of claim 6 wherein a single inversion loop document feeding path interconnects said first and second document scanning stations.

16. The apparatus of claim 6 wherein document line images from one said scanning station pass through the other said scanning station by optical alignment of said first and second projection lenses.

17. The apparatus of claim 6 including a document feeding path wherein both simplex and duplex documents are moved therethrough without stopping.

18. The apparatus of claim 6 including a document input feeder feeding directly into one of said first and second document scanning stations without inversion from a closely adjacent stack thereof in forward serial order.

19. The apparatus of claim 6 wherein all optical imaging elements thereof are fixed in position for imaging of both simplex and duplex documents.

* * * * *